US005184550A

United States Patent [19]

Beck et al.

[11] Patent Number: 5,184,550

[45] Date of Patent: Feb. 9, 1993

[54] DEVICE FOR CONTROLLING WETTING BEHAVIOR OF METAL SURFACES BY APPLICATION OF ELECTROLYTE UNDER CONTROLLED VOLTAGE

[75] Inventors: Hans-Jürgen Beck, Baar; Gabriele Nowara, Mauer, both of Fed. Rep. of Germany

[73] Assignee: Heidelberger Druckmaschinen Ag, Heidelberg, Fed. Rep. of Germany

[21] Appl. No.: 663,396

[22] Filed: Mar. 1, 1991

[30] Foreign Application Priority Data

Mar. 1, 1990 [DE] Fed. Rep. of Germany ..... 4006363

[51] Int. Cl.[5] ..... B41F 7/20; B41F 7/24

[52] U.S. Cl. ..... 101/142; 101/148; 101/450.1; 101/416.1; 204/218; 204/224 R; 205/117; 205/127; 205/151

[58] Field of Search ..... 101/423, 424, 422, 416.1, 101/450.1, 451, 452, 148; 204/224 R, 218, 433, 906; 205/117, 127, 151

[56] References Cited

U.S. PATENT DOCUMENTS

| | | | |
|---|---|---|---|
| 2,590,927 | 4/1952 | Brandt et al. | 204/224 R X |
| 2,833,702 | 5/1958 | Elfers | 204/224 R X |
| 2,961,395 | 11/1960 | Icxi | 204/224 R |
| 3,563,862 | 2/1971 | Joly et al. | 204/224 R X |
| 4,327,133 | 4/1982 | Wirz et al. | 101/422 X |
| 4,605,480 | 8/1986 | Stroszynski et al. | 204/211 |
| 4,610,772 | 9/1986 | Palnik | 204/224 R X |
| 4,872,962 | 10/1989 | Scheer et al. | 204/224 R |
| 5,009,161 | 4/1991 | Wirz | 101/423 X |

FOREIGN PATENT DOCUMENTS

| | | |
|---|---|---|
| 1235863 | 6/1971 | United Kingdom . |
| 1291771 | 10/1972 | United Kingdom . |
| 1404068 | 8/1975 | United Kingdom . |
| 1439127 | 6/1976 | United Kingdom . |
| 1515342 | 6/1978 | United Kingdom . |

*Primary Examiner*—Clifford D. Crowder
*Attorney, Agent, or Firm*—Herbert L. Lerner; Laurence A. Greenberg

[57] ABSTRACT

Apparatus for controlling the wetting behavior of the surface of a cylinder formed of passivatable metal. A wetting device is used to apply an electrolyte to the surface of the metal cylinder. A direct current source is connected between the wetting device and the cylinder and a control device is used to control the voltage necessary for passivating the surface of the cylinder as a function of the pH value of the electrolyte and the type of metal forming the surface of the cylinder. The oleophilic or oleophobic characteristics of the cylinder are thus controlled.

16 Claims, 4 Drawing Sheets

Fig. 5
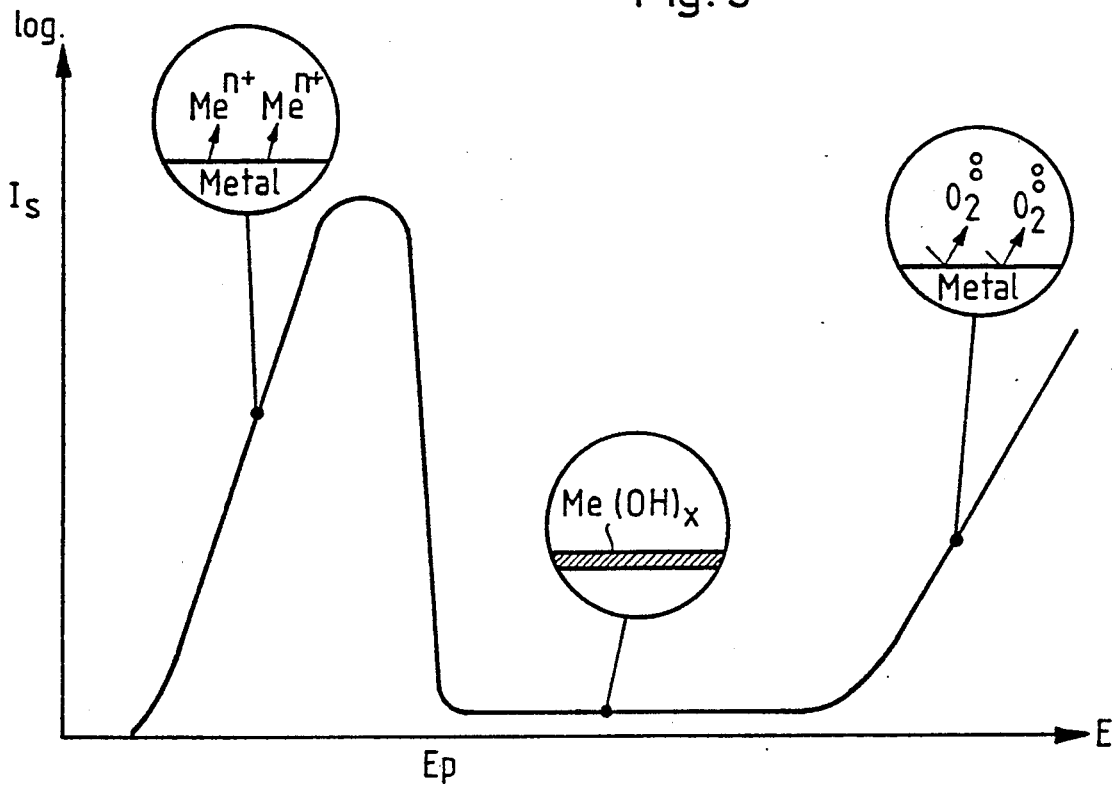
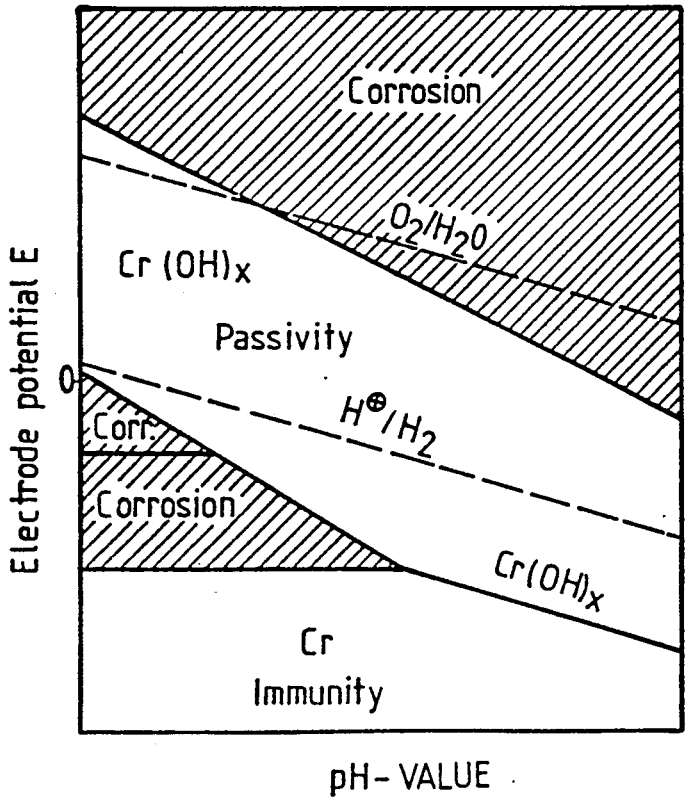
Fig. 4

DEVICE FOR CONTROLLING WETTING BEHAVIOR OF METAL SURFACES BY APPLICATION OF ELECTROLYTE UNDER CONTROLLED VOLTAGE

The invention relates to a method and a device for controlling wetting behavior of surfaces and, more particularly, for controlling wetting behavior of surfaces of cylinders in rotary printing presses.

During the sheet travel through a printing press having more than one printing unit, the freshly printed side of the sheet comes into contact with outer cylindrical surfaces of transfer cylinders. In first form and perfector printing, after a sheet which has been printed on a side thereof has been turned over, the side of the sheet which is still damp is additionally pressed against sheet-guiding surfaces of impression cylinders in the succeeding printing units of the printing press. It is of decisive importance with respect to attaining a consistently high print quality that there should be as little buildup of ink as possible on the outer cylindrical surfaces of the sheet-transfer cylinder and impression cylinders.

Many efforts have been undertaken to create a cylinder jacket with as low an ink acceptance as possible and with ink-removal characteristics which are as optimal as possible. An outstanding example is a cylinder dressing described in German Patent 24 46 188 wherein the sheet-guiding outer cylindrical surface of impression cylinders or sheet-transfer cylinders in rotary printing presses has a structure or texture formed of spherical calottes or mounds. The spherical calottes are of equal height and are statistically uniformly distributed over the surface of the cylinder dressing or covering. The surface texturing per se serves to reduce the area of the impression and thus to reduce the area of contact during perfector printing. The uniform height of the spherical calottes creates a uniform impression area, while the statistically uniform distribution of the spherical calottes counteracts the danger of a formation of undesirable moiré pattern in the printed product.

In order to minimize ink acceptance from the outset, nickel is used as the material of the foil formed with the spherical calottes. Nickel has the required physical and chemical characteristics: it is ink-repellent, wear-resistant and markedly chemically resistant to the chemicals used in a printing press.

An improvement in the aforedescribed heretofore-known cylinder dressing has been proposed in German Published Non-Prosecuted Application (DE-OS) 29 16 505 wherein a thin chromium layer, compensating for micro-roughness, is additionally applied to the textured surface of a substrate layer having good ink-removal or ink-transfer characteristics and being made from durable, wear-resistant and inflexible material, such as nickel, for example. The durable life of the substrate layer or foil and the service life of the chromium layer are thereby extended, on the one hand, and cleaning of the foil, which is necessary at given intervals, is facilitated by the smoother surface deriving from the chromium layer, on the other hand.

Despite these characteristics which are desirable with respect to ink acceptance of the metals nickel and chromium, it has been necessary from time to time heretofore to clean the impression cylinders after a sheet has been turned. It has been shown in practice that the poor ink-acceptance characteristics of chromium and nickel are particularly pronounced after the cylinder surface has been treated with an acid medium (e.g. a plate cleaner). Further experiments in this direction confirm that, ultimately, the "ink-repellent" properties of these metals occur satisfactorily only in conjunction with the addition of acidic dampening medium or fountain solution, which is indispensable in moist or wet offset printing.

Proceeding from the state of the prior art, it is accordingly an object of the invention to provide a method and device of the foregoing general type which permit a desired condition of wetting of a metal surface.

With the foregoing and other objects in view, there is provided, in accordance with the invention, a method of controlling wetting behavior of a passivatable metal, which comprises bringing an electrolyte into contact with the surface of the metal, and applying a voltage between the electrolyte and the metal having a value which is a function of the pH value of the electrolyte and of the respective metal so that an oleophilic (hydrophobic) or an oleophobic (hydrophilic) surface stat is obtained.

In accordance with another aspect of the invention, there is also provided a device for controlling wetting behavior of the surface of a cylinder formed of passivatable metal, comprising a wetting roller, for applying an electrolyte to the surface of the cylinder, and a control device for establishing a voltage between the electrolyte and the cylinder as a function of a pH value of the electrolyte and as a function of the respective metal forming the surface of the cylinder so that the surface of the cylinder is placed in a given passivated state.

The invention is based upon a heretofore known physico-chemical principle that metals from the group of transition metals, but also including aluminum, for example, can be passivated, i.e., under certain external conditions, a dense, tightly adhering oxide or hydroxide film, respectively, forms on the surface of the metal and almost completely prevents further corrosion of the metal. The so-called electrode-potential/pH diagrams (Pourbaix diagrams) are of great practical significance with respect to corrosion monitoring. These diagrams graphically represent the thermo-dynamic data of corroding systems and provide, amongst other things, precise information on how the electrode potential must be selected as a function of the pH value in order to achieve a passive surface state of the metal.

The passivation of specific metals by different chemical surface coatings is thus employed in the method and device for performing the method of controlling wetting behavior of metal surfaces in accordance with the invention.

In accordance with another feature of the invention, the wetting roller is formed of a tube of a conductive, corrosion-resistant material having transverse bores formed therethrough, the tube having a yieldable outer covering.

In accordance with a more detailed feature of the invention, the outer covering is formed of foam material. The foam material ma be synthetic.

In accordance with an alternate feature of the invention, the outer covering is a brush.

In accordance with an added feature of the invention, the tub is formed of stainless-steel.

The foregoing specific constructions provide two advantages: due to the uniform distribution of the electrolyte in the foam material or in the brush means, on the one hand, the electrical resistance within the foam material or the brush remains constant and, on the other hand, permits uniform, finely metered application of electrolyte to the respective surface of the cylinder to be wetted. The latter advantage is, of course, especially important with respect to offset printing, because the liquid, which is emulsified into the ink although in small proportions, always dilutes the latter and thus, in the final analysis, changes the ink impression and detracts from the quality of the printed product, respectively.

In accordance with an additional feature of the invention, the wetting roller is in continuous contact with the surface of the cylinder to be wetted.

In accordance with an alternate feature of the invention, there are provided means for engaging the wetting roller with the surface of the cylinder to be wetted and for disengaging the wetting roller from the surface of the cylinder to be wetted.

In accordance with yet another feature of the invention, there are provided means for supporting the wetting roller in the side walls of a printing unit.

In accordance with yet a more specific feature of the invention, the supporting means are comprised of parts formed of plastic material. The provision of this feature dispenses with the need for any further precautions relating to the electrical isolation of the wetting roller.

In accordance with yet a further feature of the invention, there are provided separate drive means for the wetting roller.

In accordance with an alternate feature of the invention, the wetting roller is in frictional contact with the surface of the cylinder to be wetted so as to be drivable thereby.

A respective wetting roller is assigned to a cylinder which is in direct contact with the yet damp side of a freshly printed sheet. In the case of single side or first form printing, these cylinders are the transfer cylinders according to the invention; in the case of first form and perfector printing, these cylinders are the transfer cylinders and especially the impression cylinders after or downstream from a location at which the sheet has been turned, in accordance with the invention.

In accordance with yet a further feature of the invention, there is provided a printing machine having a dampening unit with a dampening-medium distributor roller, wherein the wetting roller is engageable with the dampening-medium distributor roller. By means of a suitably selected voltage between the electrolyte and the dampening-medium distributor roller, it is thus possible to form an oleophobic (hydrophilic) hydroxide layer on the outer cylindrical surface of the dampening-medium distributor roller which passivates the surface of the latter.

In accordance with a concomitant feature of the invention, there is provided a printing machine having a plate cylinder and a dampening unit, wherein the wetting roller serves as a dampening-medium applicator roller and the cylinder formed of passivated material is the plate cylinder, the wetting roller being engageable with the plate cylinder.

The printing areas of a printing form for offset printing are formed of an oleophilic diazo-coating whereas, in the non-printing image areas, the diazo-layer is washed out after exposure, and oleophobic plate material, usually aluminum, is exposed at the surface. Despite a protective coating of the plate with, for example, gum arabic, the aluminum oxidizes into oleophilic aluminum oxide. A consequence thereof is that the originally image-free areas of the printing form begin to accept ink during the printing process, and scumming results. The method and device according to the invention effectively counteract or oppose this oxide formation in the image-free areas of the printing form. The service life of the printing form is thereby considerably prolonged.

Other features which are considered as characteristic for the invention are set forth in the appended claims.

Although the invention is illustrated and described herein as embodied in a method and device for controlling wetting behavior of surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1*a* is a diagrammatic side elevational view of one of the printing units of a printing press having two printing units and incorporating the device according to the invention;

FIG. 1*b* is a view like that of FIG. 1*a* of the other printing unit of the printing press also incorporating the device according to the invention;

FIG. 4 is a potential/pH diagram of chromium;

FIG. 5 is a plot diagram which is a logarithmic representation of anodic current density as a function of applied voltage and providing an anodic polarization curve for a passivatable metal in a electrolyte.

Figure 1A:
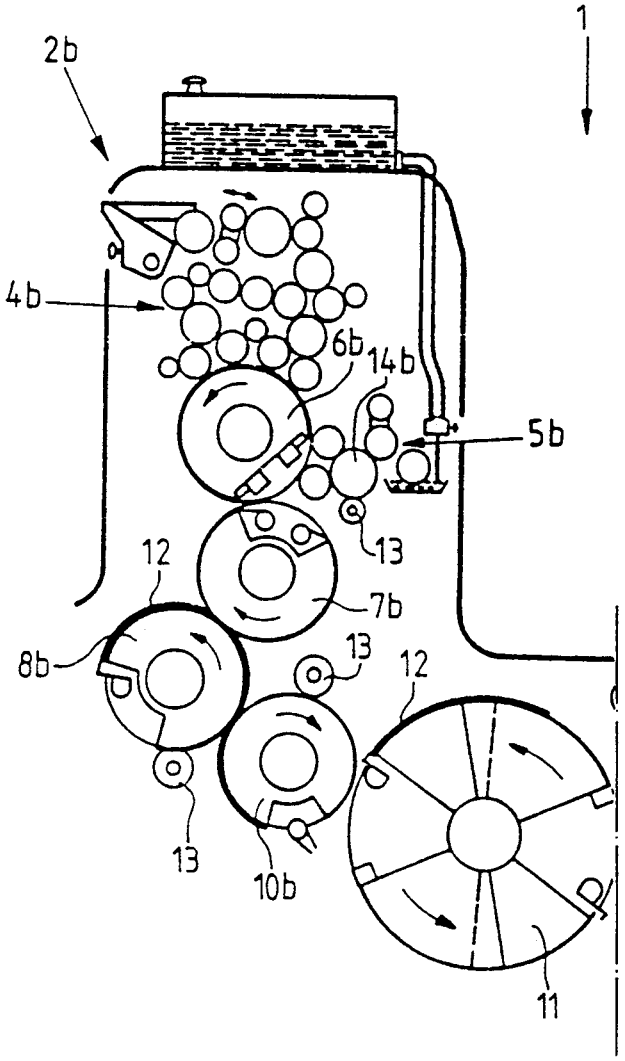
Figure 1B:
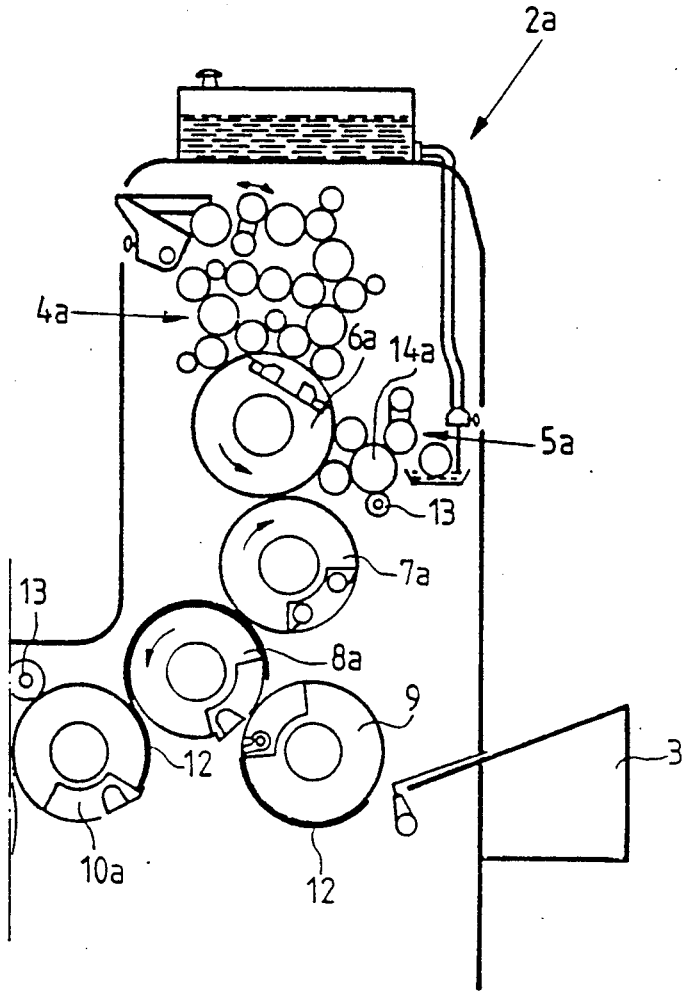

Referring now to the drawing and, first, particularly to FIGS. 1*a* and 1*b*, there is shown therein a printing press 1 having two printing units 2*a* and 2*b*. A feed table 3 is also diagrammatically shown in FIG. 1*b*. Both printing units 2*a* and 2*b* have a conventional roller arrangement of inking units 4*a* and 4*b* and dampening units 5*a* and 5*b*. Printing forms, respectively, are mounted on plate cylinders 6*a* and 6*b*. The inked printing forms transfer a printed image onto rubber blanket cylinders 7*a* and 7*b*. From the rubber blanket cylinders 7*a* and 7*b*, the subject is applied to a sheet 12. FIGS. 1*a* and 1*b* clearly show how the sheet 12 passes through the two printing units 2*a* and 2*b* of the printing press 1. The sheet 12 is gripped at its leading edge by a gripper system of a register feed drum 9 and is accelerated to press speed.

The subject is printed in a respective color on the impression cylinder 8*a*. As it is transported farther via the transfer cylinder 10*a*, the freshly printed side of the sheet comes into contact with the outer cylindrical surface of the cylinder 10*a*. In the case of first form or front side printing, diagrammatically illustrated grippers of a storage drum 11 grip the sheet 12 by its leading edge, and the printed side of the sheet 12 lies on the outer cylindrical surface of the transfer cylinder 10*b* of the second printing unit 2*b*.

In the case of first form and perfector printing, the trailing edge of the sheet 12 is gripped by the grippers of the storage drum 11 and is transported via the transfer cylinder 10*b* to the next printing unit 2*b*. The freshly printed side of the sheet 12 then lies on the impression cylinder 8*b*. Because the subject is printed under pressure, poor ink-acceptance and good ink-removal characteristics, respectively, of the outer cylindrical surface of this impression cylinder 8*b* play a decisive role with regard to the quality of the printed product. Further shown in FIGS. 1*a* and 1*b* are what possible points of location or application for wetting rollers 13 may be provided in a printing press. The wetting rollers 13 are of advantage wherever the freshly printed side of a sheet rests on the surface of a cylinder. Furthermore, it is possible either to bring a wetting roller 13 into engagement with a dampening-medium distributor roller 14*a* and 14*b* or to use the wetting roller 13 as a dampening-medium applicator roller.

Figure 2:
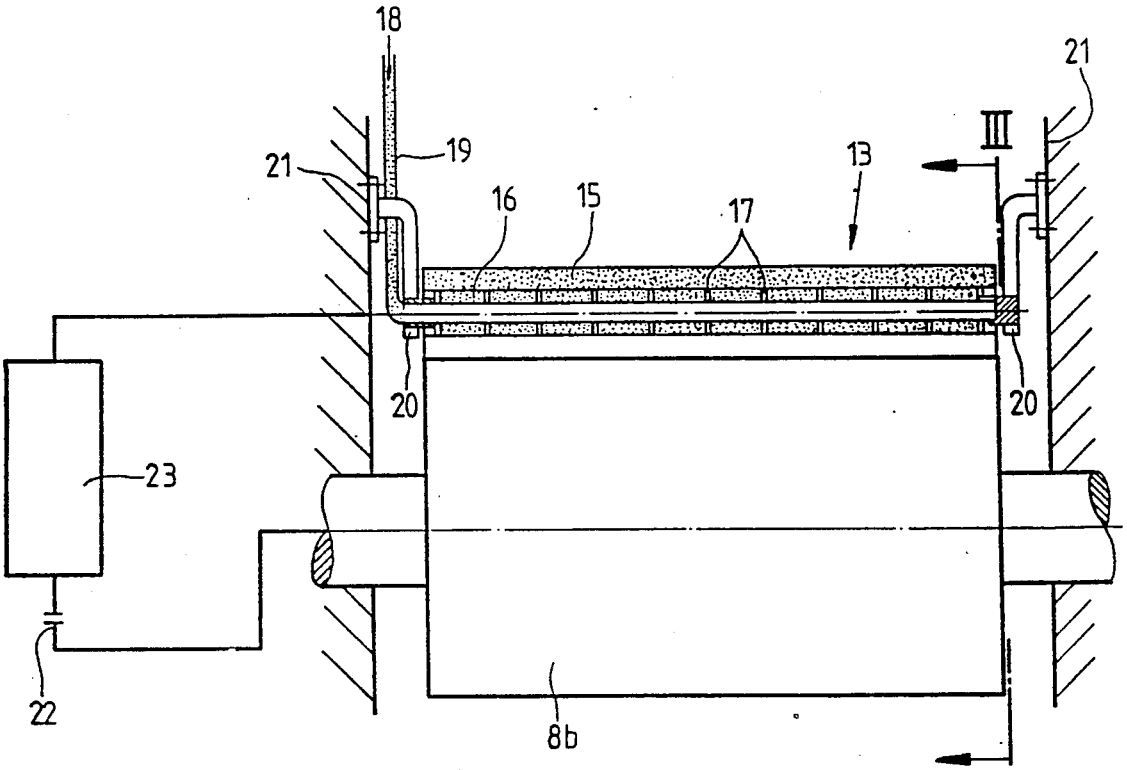
FIG. 2 is an enlarged longitudinal sectional view, partly schematic, of the device according to the invention.
Figure 3:
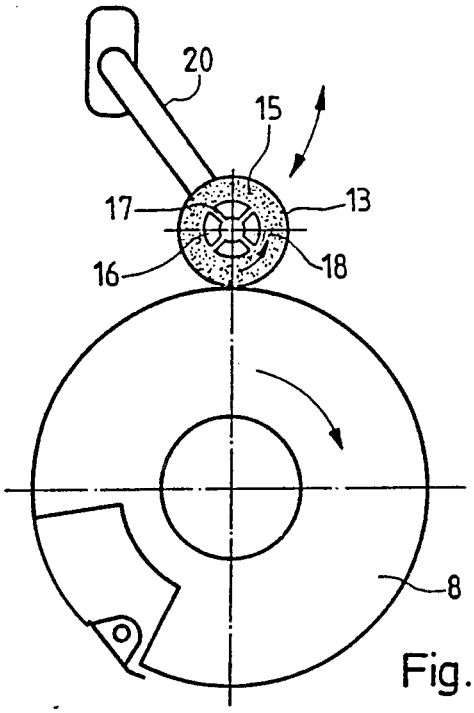
FIG. 3 is a cross-sectional view of FIG. 2 taken along the line III—III in the direction of the arrows.

FIGS. 2 and 3 are related to the construction of the wetting roller 13 and to how it is attached to side walls 21 of the respective printing units 2*a* and 2*b*. FIG. 2 offers a longitudinal view of the impression cylinder 8*b* of the printing unit 2*b*. The cylinder 8*b* has a shaft which is journaled or engages in corresponding bores formed in the side walls 21 of the printing unit 2*b*. The wetting roller 13, shown in a longitudinal sectional view, is in engagement with the outer cylindrical surface of the cylinder 8*b*. By means of a fastening device 20, the wetting roller 13 is attached to the side walls 21 of the printing unit 2*b*. The fastening device 20 is formed of plastic material which automatically insulates or isolates the wetting roller 13 electrically from the printing press 1. The wetting roller 13 is formed of a stainless-steel tube 16 with transverse bores 17 formed therethrough and is provided with a covering 15 of foam material. An electrolyte 18 is supplied to the stainless-steel tube 16 via a supply line 19. A non-illustrated conventional control device controls or permits control of the pH value of the electrolyte 18 as well as the supply of electrolyte 18 to the wetting roller 13 so that a constant pH value of the electrolyte 18 is assured. A direct-current source 22 is connected between the electrolyte 18 and the impression cylinder 8*b*, and the voltage necessary for passivating the surface of the impression cylinder 8*b* is computer-controlled as a function of the pH value of the electrolyte 18 by means of a control device 23. Suitable control data ar derived from previously stored characteristics.

FIG. 3 is a cross-sectional view of FIG. 2. The wetting roller 13 with the stainless-steel tube 16 formed with the transverse bores 17 and covered with the foam material 15 is mounted so that it can be brought into and out of engagement, respectively, with the impression cylinder 8*b*, the wetting roller 13 being swiveled, for example, under cam control.

FIG. 4 is a so-called potential/pH diagram of the passivatable metal chromium (Cr). The single-line hatched areas identify those regions in which corrosion, i.e., decomposition or disintegration of the metal, occurs, while the non-hatched areas mark regions in which the metal is passivated by a dense surface layer of oxide or hydroxide. The broken lines indicate the pH-dependent redox potential of the solutions, which are in equilibrium with hydrogen and oxygen.

In the plot diagram of FIG. 5, a so-called anodic polarization curve for a passivatable metal in an electrolyte is represented. For this purpose, the common logarithm of the anodic net current I from the electrode into the solution is plotted against the electrode potential E. Without external current, there is a stationary electrode potential. When the potential is increased, an anodic net current I flows from the electrode into the solutions and the metal dissolves or disintegrates. If the potential is further increased, a saturation current $I_S$ is obtained. If the potential E is increased above the so-called passivation Ep, a thin, pore-free hydroxide layer is formed on the surface of the metal. This passivation of the metal results in a very distinct drop in the current I by several powers of ten. If the anode potential is further increased, the current remains constant until a stage is reached at which oxygen is developed from water. In this so-called transpassive region, the current again rises sharply.

We claim:

1. Device for controlling wetting behavior of the surface of a cylinder formed of passivatable metal, comprising a wetting roller, for applying an electrolyte to the surface of the cylinder, and a control device for establishing a voltage between the electrolyte and the cylinder having a value which is a function of a pH value of the electrolyte and a function of the respective metal forming the surface of said cylinder so that the surface of the cylinder is placed in a given passivated state.

2. Device according to claim 1, wherein said wetting roller is formed of a tube of a conductive, corrosion-resistant material having transverse bores formed therethrough, said tube having a yieldable outer covering.

3. Device according to claim 2, wherein said outer covering is formed of foam material.

4. Device according to claim 2, wherein said outer covering a brush.

5. Device according to claim 2, wherein said tube is formed of stainless-steel.

6. Device according to claim 1, wherein said wetting roller is in continuous contact with the surface of said cylinder to be wetted.

7. Device according to claim 1, including means for engaging said wetting roller with the surface of said cylinder to be wetted and for disengaging said wetting roller from the surface of said cylinder to be wetted.

8. Device according to claim 1, including means for supporting said wetting roller in the side walls of a printing unit.

9. Device according to claim 8, wherein said supporting means are comprised of parts formed of plastic material.

10. Device according to claim 1, including separate drive means for said wetting roller.

11. Device according to claim 1, wherein said wetting roller is in frictional contact with the surface of the cylinder to be wetted so a to be drivable thereby.

12. Device according to claim 1, wherein said cylinder is a transfer cylinder engageable by said wetting roller.

13. Device for controlling wetting behavior of the surface of a cylinder formed of passivatable metal, comprising wetting means for applying an electrolyte to the surface of the cylinder, and control means for establishing a voltage between the electrolyte and the cylinder having a value which is a function of the respective metal forming the surface of the cylinder and a pH value of the electrolyte so that the surface of the cylinder is placed in a selective passivated state wherein it is oleophilic or oleophobic.

14. In combination with a first form and perfector printing machine having an impression cylinder with a surface formed of passivatable metal, a device for controlling wetting behavior of the surface of the impression cylinder, comprising a wetting roller engageable with the impression cylinder for applying an electrolyte to the surface of the impression cylinder, and control means for establishing a voltage between the electrolyte and the impression cylinder having a value which is a function of the respective metal forming the surface of the impression cylinder and a pH value of the electrolyte, so that the surface of the impression cylinder is placed in selective passivated states wherein it is oleophilic or oleophobic.

15. In combination with a printing machine having a dampening unit with a dampening-medium distributor roller with a surface formed of passivatable metal, a device for controlling wetting behavior of the surface of the distributor roller, comprising a wetting roller engageable with the distributor roller for applying an electrolyte to the surface of the distributor roller, and control means for establishing a voltage between the electrolyte and the distributor roller having a value which is a function of the respective metal forming the surface of the distributor roller and a pH value of the electrolyte so that the surface of the distributor roller is placed in selective passivated states wherein it is oleophilic or oleophobic.

16. In combination with a printing machine having a plate cylinder with a surface formed of passivatable metal and a dampening unit having a dampening-medium applicator roller, a device for controlling wetting behavior of the surface of the plate cylinder, comprising means for having the dampening-medium applicator roller serve as a wetting roller engageable with the plate cylinder for applying an electrolyte to the surface of the plate cylinder, and control means for establishing a voltage between the electrolyte and the plate cylinder having a value which is a function of the respective metal forming the surface of the plate cylinder and a pH value of the electrolyte so that the surface of the plate cylinder is placed in selective passivated states wherein it is oleophilic or oleophobic.

* * * * *